US008234806B1

(12) United States Patent
Raheb

(10) Patent No.: US 8,234,806 B1
(45) Date of Patent: Aug. 7, 2012

(54) TICKET HOLDER

(75) Inventor: Gregory A. Raheb, Central Falls, RI (US)

(73) Assignee: Raheb Stanley LLC, Central Falls, RI (US)

( * ) Notice: Subject to any disclaimer, the term of this patent is extended or adjusted under 35 U.S.C. 154(b) by 126 days.

(21) Appl. No.: 12/752,407

(22) Filed: Apr. 1, 2010

Related U.S. Application Data

(60) Provisional application No. 61/168,697, filed on Apr. 13, 2009.

(51) Int. Cl.
*G09F 3/18* (2006.01)

(52) U.S. Cl. ..... 40/658; 40/124; 248/280.11

(58) Field of Classification Search ..... 40/617; 248/458, 462, 27.3, 229.1; 211/124, 95, 211/98, 101, 113, 115, 117, 89, 112
See application file for complete search history.

(56) References Cited

U.S. PATENT DOCUMENTS 2,636,549 A * 4/1953 Geller ..... 248/240.2
2,650,715 A * 9/1953 Lundstrom ..... 211/103
3,075,335 A * 1/1963 Bandlow ..... 55/385.1
3,314,177 A * 4/1967 Mies, Jr. et al. ..... 40/124
3,953,065 A * 4/1976 Shannon, Jr. ..... 294/103.1
4,768,744 A * 9/1988 Leeds et al. ..... 248/280.11
4,909,464 A * 3/1990 Levine et al. ..... 248/220.22
5,452,875 A * 9/1995 Kern ..... 248/242
5,681,017 A * 10/1997 Clausen ..... 248/125.1
5,711,431 A * 1/1998 Reichert ..... 211/45
6,134,103 A * 10/2000 Ghanma ..... 361/679.05
6,233,102 B1 * 5/2001 Hogan, Jr. ..... 359/802
6,302,278 B1 * 10/2001 Dueck ..... 211/17
6,378,818 B1 * 4/2002 Padiak et al. ..... 248/201
6,691,963 B1 * 2/2004 Padiak et al. ..... 248/220.22
6,796,064 B2 * 9/2004 Gibson et al. ..... 40/606.15
7,143,534 B2 * 12/2006 Kaminski ..... 40/606.15
7,764,197 B2 * 7/2010 Allen et al. ..... 340/933
2008/0135042 A1 * 6/2008 Negandhi et al. ..... 126/299 D

* cited by examiner

*Primary Examiner* — Lesley D. Morris
*Assistant Examiner* — Shin Kim
(74) *Attorney, Agent, or Firm* — Salter & Michaelson

(57) ABSTRACT

A ticket holding system mounted over a cooking station in view of a user of the cooking station and for holding one or more order tickets for meals being prepared and viewable by the user. The ticket holding system includes an elongated ticket holder; an elongated ticket retainer that is secured to a face surface of the elongated ticket holder and capable of releasably retaining one or more order tickets; and a pair of brackets that support the ticket holder at a position disposed over the cooking station. The pair of brackets are mounted from respective support surfaces that are spaced apart so that the brackets are spaced from each other and mount the ticket holder therebetween. The pair of brackets and ticket holder are cooperatively constructed and arranged so that the ticket holder can be both pivotal relative to the brackets and adjusted in height.

17 Claims, 10 Drawing Sheets

TICKET HOLDER

RELATED CASES

Priority for this application is hereby claimed under 35 U.S.C. §119(e) to commonly owned and co-pending U.S. Provisional Patent Application No. 61/168,697 which was filed on Apr. 13, 2009 and which is incorporated by reference herein in its entirety.

FIELD OF THE INVENTION

The present invention relates in general to a ticket holder. More particularly, the present invention relates to a ticket holder device that is particularly adapted for use in association with a cooking station, although, the principles of the present invention could also be applied for use with other types of work stations.

BACKGROUND OF THE INVENTION

It is typical that, at a cooking station, the orders that are being filled are not readily observable at the cooking station. It is typical for the order tickets to be disposed closer to a location where the orders are submitted. This is quite inconvenient in that the chef has to continuously move to observe the order while cooking.

Accordingly, it is an object of the present invention to provide an improved ticket holder, particularly, for use in association with a cooking station, and in which the holder is disposed more conveniently with regard to the cooking station area.

Another object of the present invention is to provide an improved ticket holder system that is relatively simple in construction, can be manufactured inexpensively, and is easy to install.

SUMMARY OF THE INVENTION

To accomplish the foregoing and other objects, features and advantages of the present invention, there is provided a ticket holder that may be provided in one or more sections and that is disposed in a convenient manner for ready viewing by the cooking attendant. The preferred positioning is over or in front of the cooking station. In accordance with the present invention the ticket holder has multiple adjustments and is comprised of a substantially horizontally disposed holder, spaced apart vertical brackets for supporting the holder and a ticket retainer that is secured to the holder. The holder may be adjusted between different vertical positions and may also be pivoted so as to place the order tickets in a more convenient location for viewing.

In accordance with the present invention there is provided a ticket holding system mounted over a cooking station in view of a user of the cooking station and for holding one or more order tickets for meals being prepared and viewable by the user. The system includes an elongated ticket holder; an elongated ticket retainer that is secured to a face surface of the elongated ticket holder and capable of releasably retaining one or more order tickets; and a pair of brackets that support the ticket holder at a position disposed over the cooking station. The pair of brackets are mounted from respective support surfaces that are spaced apart so that the brackets are spaced from each other and mount the ticket holder therebetween. The pair of brackets and ticket holder are cooperatively constructed and arranged so that the ticket holder can be both pivotal relative to the brackets and adjusted in height.

In accordance with other aspects of the present invention are the following: including means for retaining the holder between the brackets and supporting the holder for adjustment in position relative to the brackets, and wherein each of the brackets are supported from a separate member defining the support surface; wherein each bracket includes a longitudinal slot disposed along a length thereof, and a pivot hole; including a first fastener for fixedly securing the holder to a lower area of the bracket and a second fastener for securing an upper area of the bracket to the separate member; wherein each bracket includes a top section having the slot, a bottom section having the hole and a middle section that tapers between the top and bottom sections; wherein the means for retaining includes fastener means that enable the bracket to slide linearly, as well as to pivot relative to the ticket holder; including a rail for support of one of the brackets, the bracket disposed substantially orthogonal to the rail; including a pair of holders with one end of each holder supported from a sidewall and a common end of the holders supported from the rail; and wherein each bracket includes a longitudinal slot disposed along a length thereof, and a pivot hole, and further including a first fastener for fixedly securing the holder to a lower area of the bracket and a second fastener for securing an upper area of the bracket to the separate member.

DESCRIPTION OF THE DRAWINGS

Numerous other advantages will be realized in connection with the following detailed description, as taken in conjunction with the accompanying drawings, in which.

DETAILED DESCRIPTION

Figure 1:
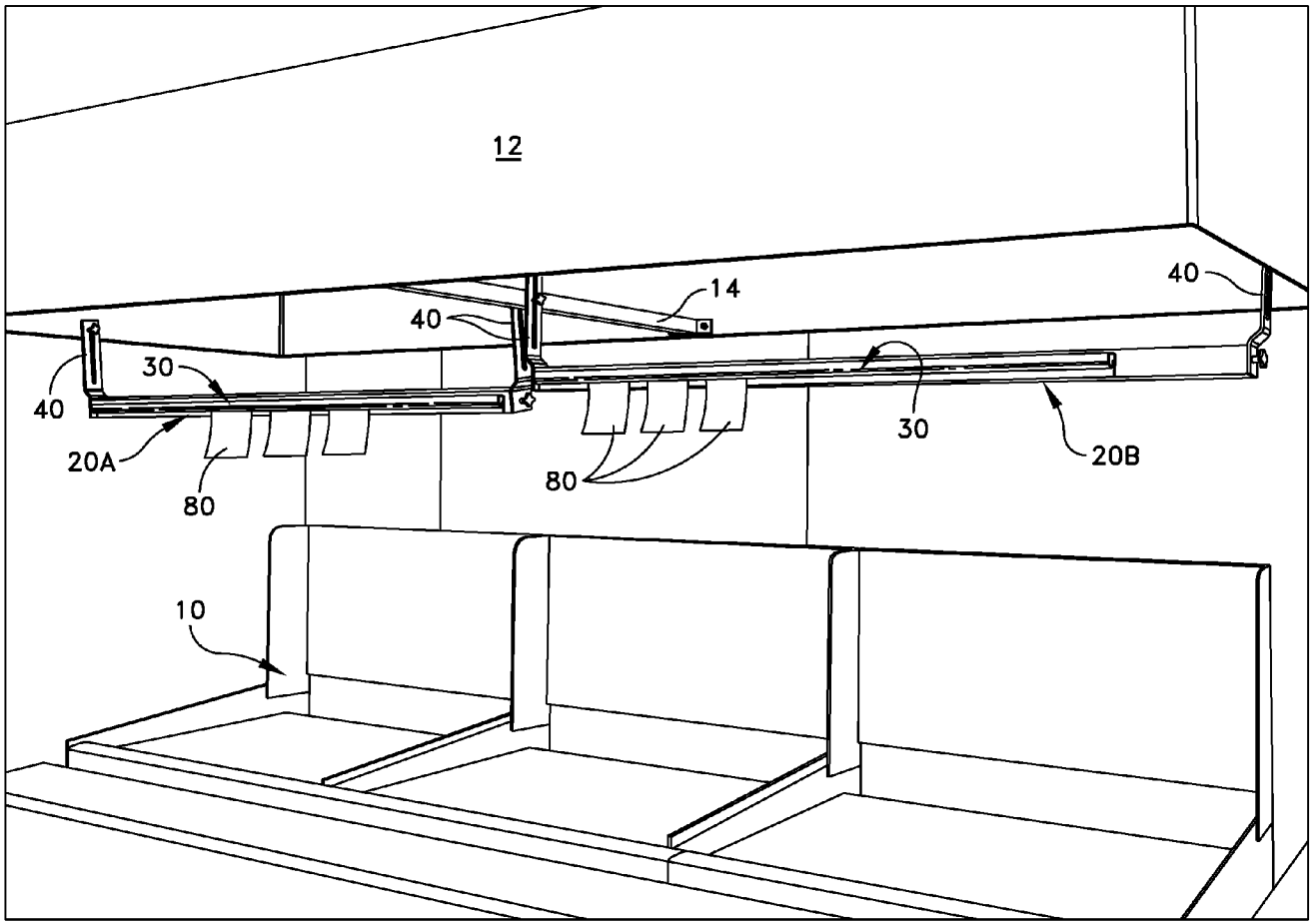
FIG. 1 is a perspective view of the order ticket holder of the present invention.

Reference is now made to the perspective view of FIG. 1 wherein there is shown a cooking station 10 which typically also includes an overhead vent 12. For the particular embodiment that is described herein, there is provided a pair of horizontally disposed holders 20. These are illustrated in FIG. 1 as separate holders 20A and 20B. In this particular arrangement, the holder 20B is longer than the holder 20A. The principles of the present invention also apply to the use of a single holder or more than two holders. The cooking station 10 is illustrated as having three separate cooking areas. These cooking areas may be of virtually any type including, but not limited to, electric, gas fired, propane fires or others. In FIG. 1 there is illustrated one holder over a single cooking unit and a longer holder over a pair of cooking units. The number of cooking units may also vary, as well as the length of each holder.

Figure 9:
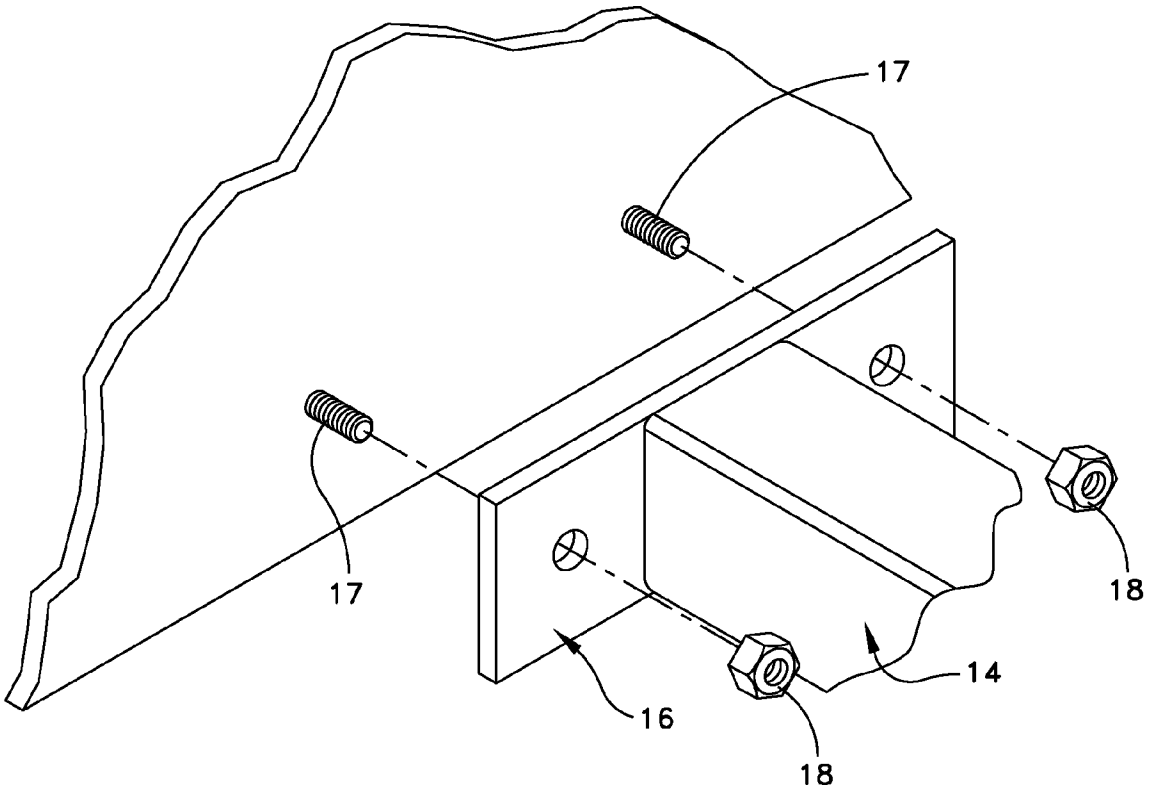
FIG. 9 is a partial perspective view showing the mounting of a center rail.

For the two holders illustrated in FIG. 1, there is provided a center rail 14 that extends from front to back and that may be supported by a bracket 16 as is illustrated in FIG. 9. For this purpose there may be provided a bolt and nut arrangement. This is illustrated in FIG. 9 by the bolt threads 17 that are adapted to engage through holes in the bracket 16 and secured by means of the respective nuts 18. The nuts 18 may be self-locking nuts. In FIG. 9 a pair of bolts 17 is illustrated. However, any number of bolts or other fasteners may be used to hold the rail in place. Many of the components shown herein may be constructed of a number of different materials, although the preferred construction is of metal, and preferably a lightweight metal such as a thin steel of aluminum.

Figure 2:
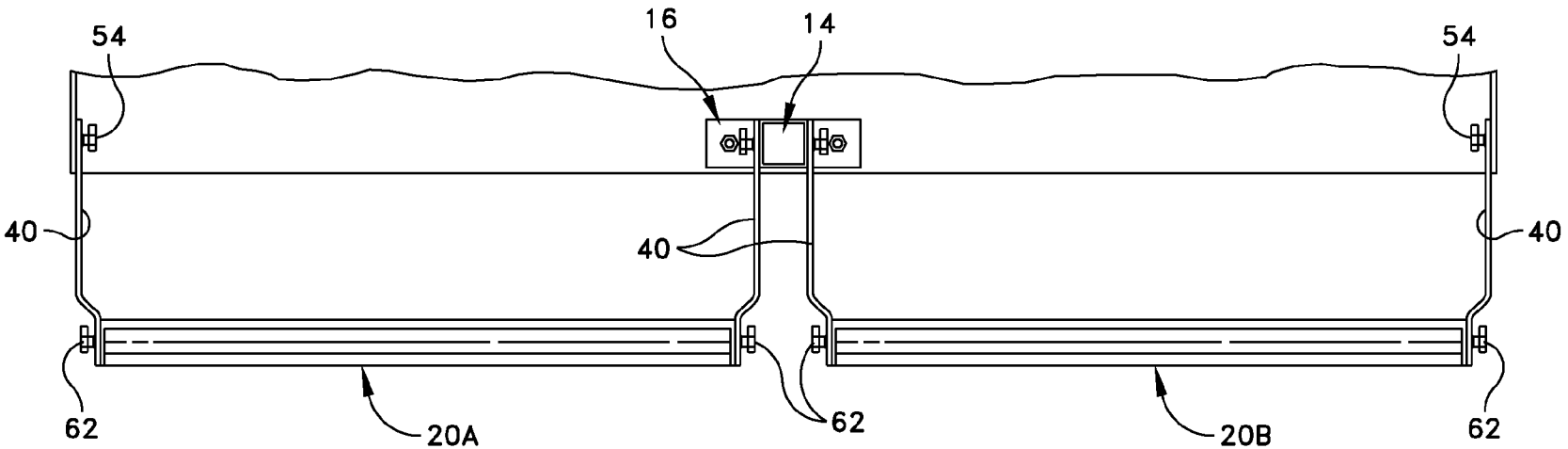
FIG. 2 is a front view of the holder of FIG. 1.
Figure 3:
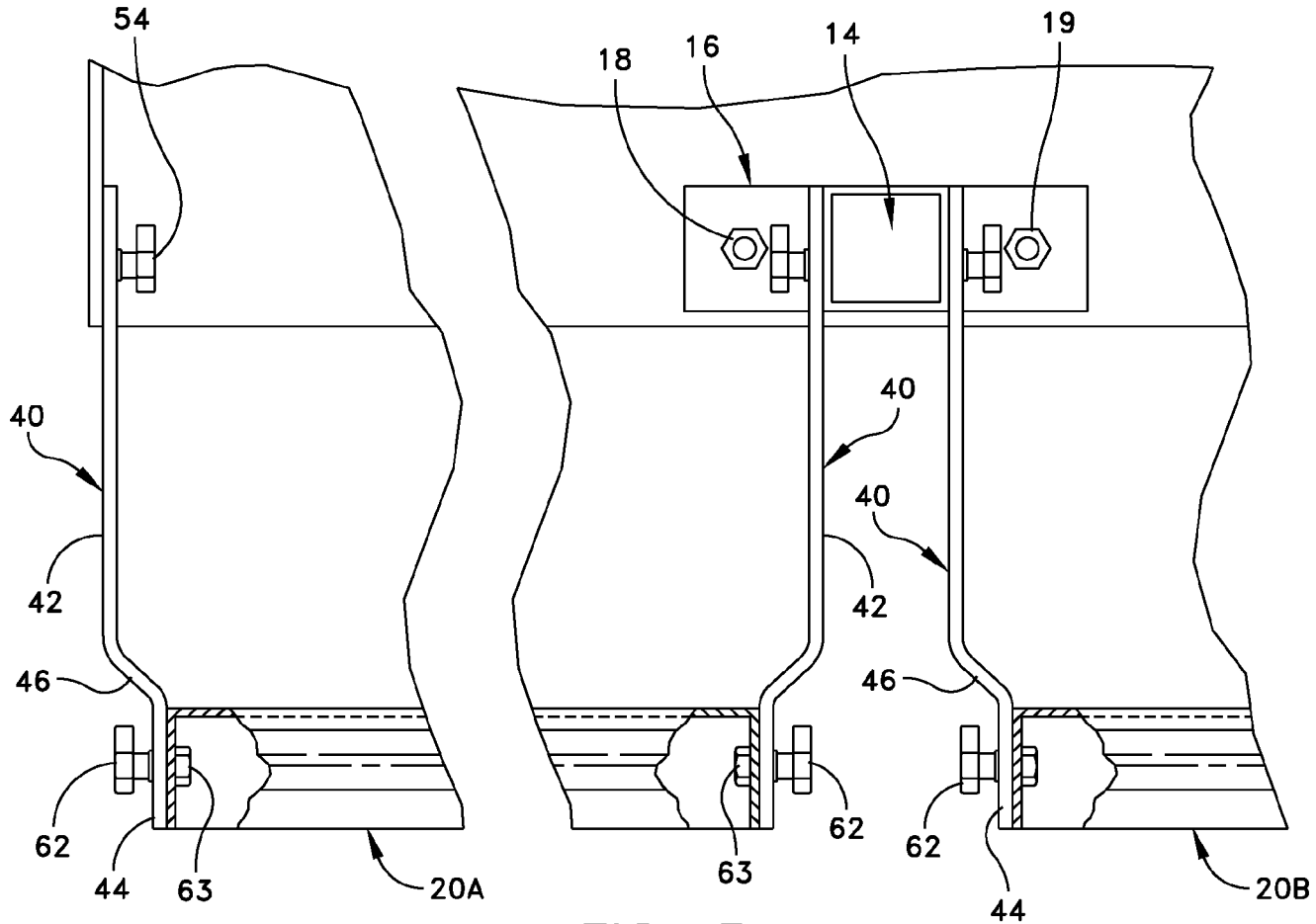
FIG. 3 is a partial and enlarged front view.

Regarding the rail 14, also refer to FIGS. 2 and 3 for an illustration of the bracket 16 and center rail 14. The front of the rail 14 may be attached in a similar manner at the inner surface of the front wall of the vent or hood 12. The rail 14, as illustrated in FIG. 1, is disposed, from front side to back side of the vent, but off-center of the vent 12 so that the holder 20A is supported substantially over a left-hand one of the cooking stations while the holder 20B is disposed over a pair of right side cooking stations. In the arrangement of FIG. 1 there may also be used a pair of rails 14 evenly spaced so that one rail is aligned with the juncture between the middle cooking station and the left hand cooking station, while the other rail is aligned with the juncture between the middle cooking station and the right hand cooking station.

Figure 6:
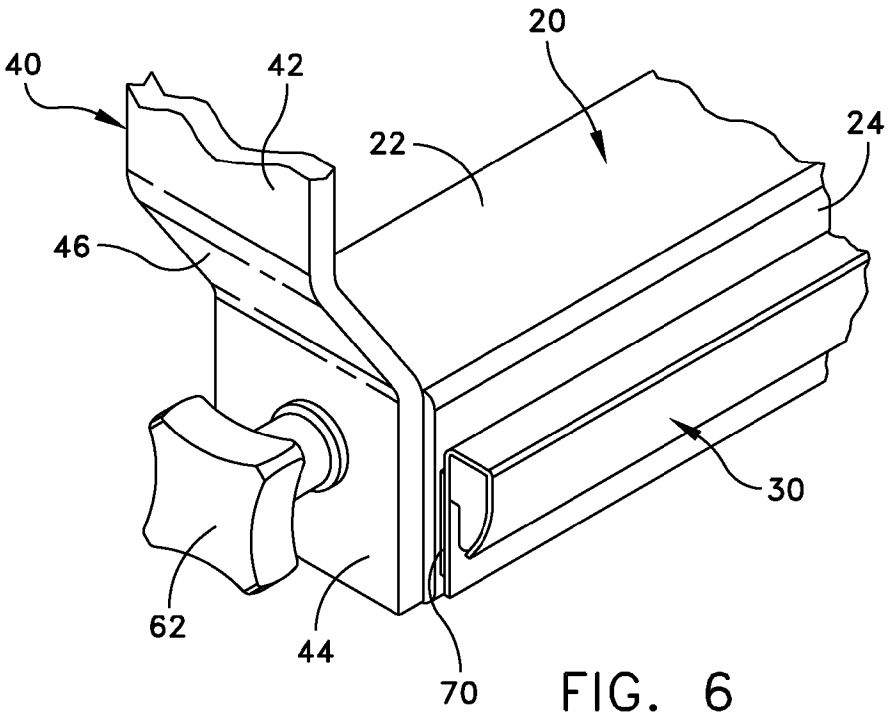
FIG. 6 is a partial front view showing the ticket retainer attached to the holder.
Figure 8:
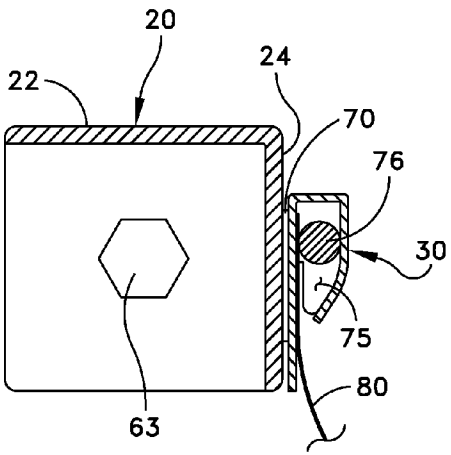
FIG. 8 is a cross-sectional view taken along line 8-8 of FIG. 7.
Figure 7:
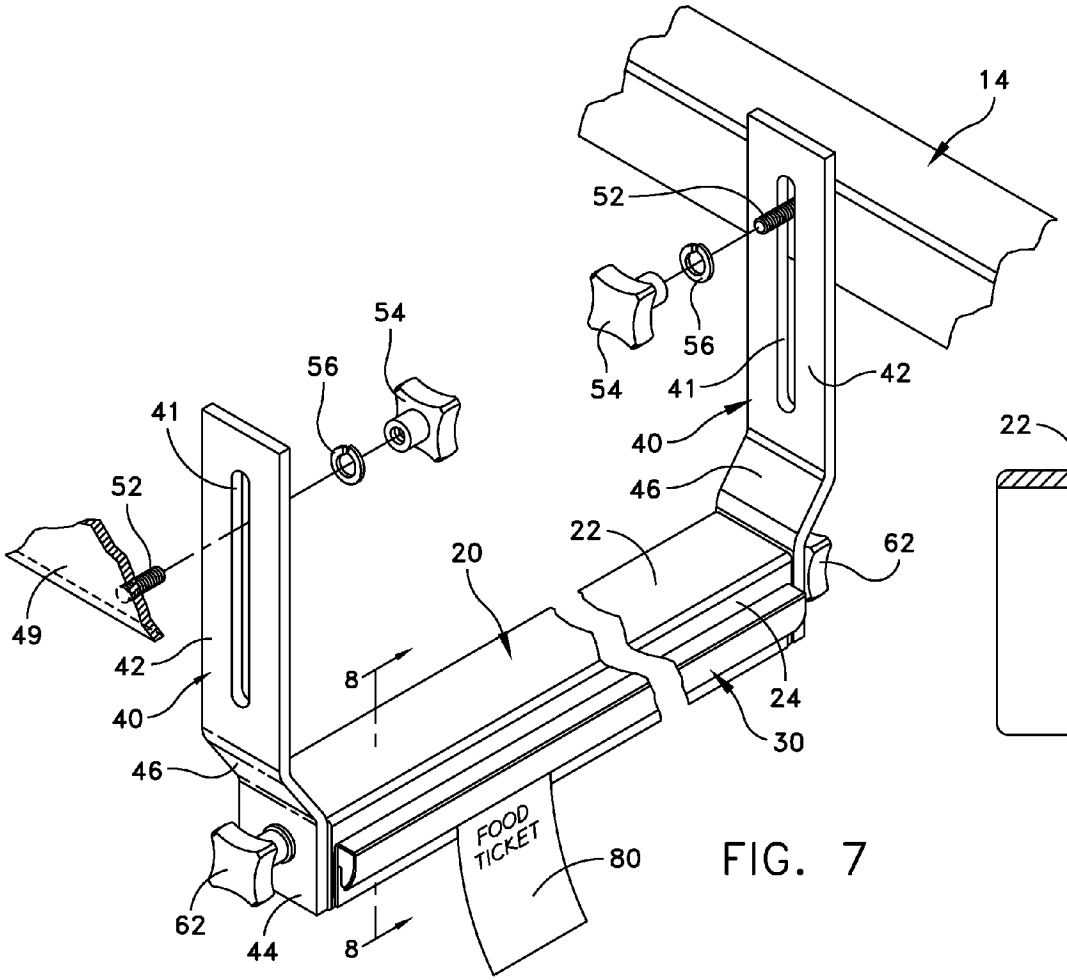
FIG. 7 is an exploded assembly view of the holder of the present invention.

Reference may now be made to FIGS. 4-8 for further details of each of the holders 20A and 20B. As illustrated in FIGS. 7 and 8, each of the holders 20 may have an inverted L-shaped configuration with a top wall 22 and a vertical wall 24. A ticket retainer 30, which will be described in further details hereinafter, is attached to the front wall 24. The holder 20 also includes opposite end walls 26, particularly shown in the exploded view of FIG. 4. In an alternate embodiment of the present invention, rather than the inverted L-shaped configuration of the holder 20, the holder 20 may be comprised of four walls disposed in a square or rectangular manner. The two walls illustrated in FIG. 8 are preferred as that makes the holder lighter in weight. In still another version the holder 2*o* may include a bottom wall instead of the top wall and vertical wall.

Figure 4:
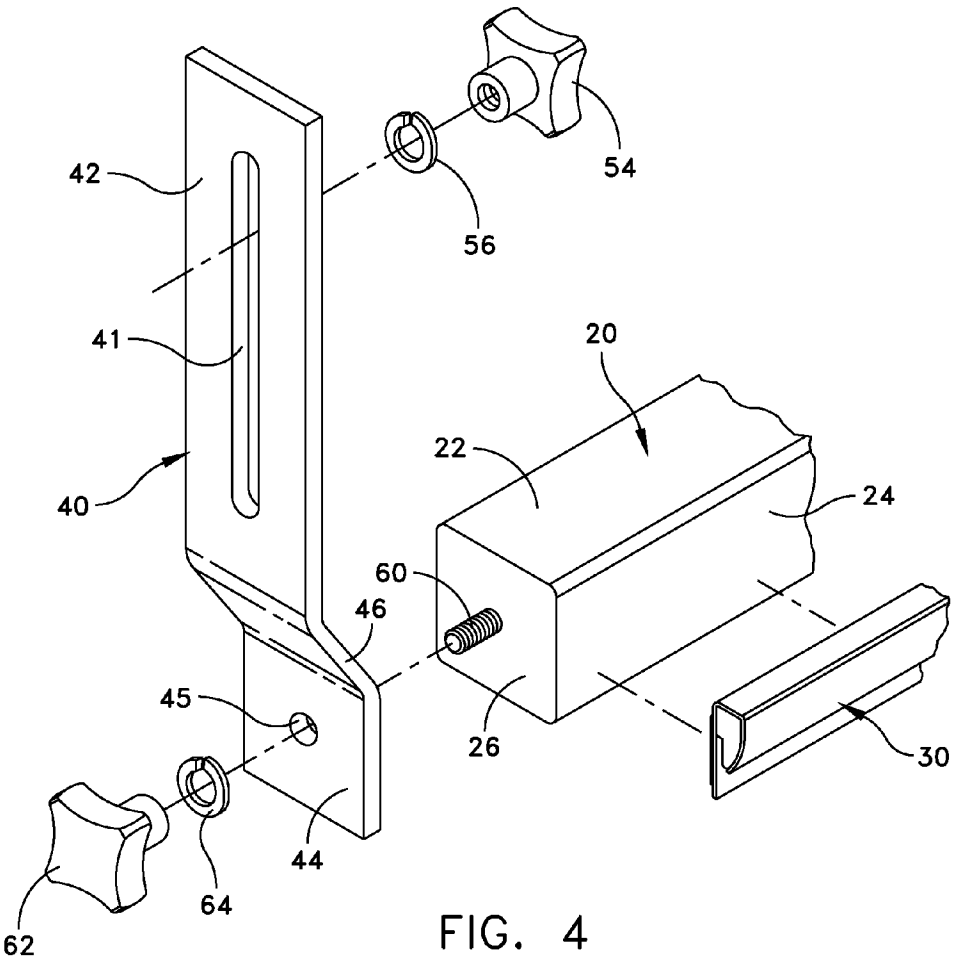
FIG. 4 is an exploded perspective view showing the connection between the holder and bracket.

As illustrated, for example, in certain of FIGS. 1 through 7, each of the holders 20 is supported at its ends by means of respective brackets 40. FIGS. 4 and 7, in particular, illustrate the construction of the bracket 40. Each of the brackets 40 includes an upper elongated section 42, a lower substantially flat section 44, and an intermediate tapered or diagonal section 46. As illustrated in, for example, FIG. 7, the tapered sections of the respective brackets are arranged so that the upper sections of each bracket are spaced outwardly from the holder 20. In this regard refer also to FIG. 3 that shows the upper sections spaced outwardly of the holder. This tapering allows adjacent holders to be disposed quite close together as illustrated in the perspective view of FIG. 1.

Each of the upper sections 42 of the bracket 40 has an elongated slot 41 for supporting each of the brackets 40 from either an end wall 49 as shown in FIG. 7 or from the central rail 14, as also shown in FIG. 7. For this purpose, a bolt may be used, such as the bolt 52 illustrated in the drawings. In this regard refer in FIG. 7 to the threaded ends of the bolts 52 of bolts that are adapted to extend into the slot 41. The bolt 52 toward the right in FIG. 7 is shown passing through the slot 41 in the bracket section 42. The bracket 40 is preferably provided with an elongated slot rather than a single round hole so that the holder can, not only pivot, but also can be adjusted in an up and down direction.

In order to secure the brackets in place, a knob 54 is used along with an associated lock washer 56 that is used for engagement with the threaded member 52. The threaded portion illustrated in, for example, FIG. 7 can be part of the bolt 52, or alternatively a threaded section can be provided by welding a threaded section to the rail 14 or to the wall 49. Also, other types of fasteners can be used for holding the bracket to the wall and/or the rail, while still allowing bracket adjustment longitudinally as well as pivotally. The knob 54 is a well known component with an internal threaded passage that mates with the threaded member 52. By tightening the knob 54 this action secures the position of the top of the bracket relative to the rail or sidewall.

The lower section of each of the brackets 40 is also provided with a hole 45 (see FIG. 4). FIG. 4 also illustrates a threaded piece 60 that may be part of a bolt that may be engaged through the hole 45 and secured by means of the knob 62 and associated lock washer 64. In FIG. 4 the threaded member 60 may be part of a bolt or alternatively may be a threaded section that is welded to the end wall 26 of the holder 20. Refer also to FIG. 3 which shows the use of a possible bolt by the head illustrated at 63. In that instance a bolt may be used that passes through a hole in the end wall 26. Other locking devices may be used for holding such a bolt in place.

In the exploded perspective view of FIG. 7 it is noted that the brackets 40 are shown in a substantially vertical position and the holder 20 is shown in a substantially horizontal position and not rotated relative to the brackets. The knobs 54 are used for securing the top of the bracket 40 in this position. The lower knobs 62 used for securing the holder 20 to the bottom section 44 of the bracket 40. In this position it is noted that the holder 20 is rotationally in alignment with the lower section 44, as also illustrated in the schematic position of FIG. 11. In other words, when the brackets 40 are upright then the holder face 24 is also upright.

Figure 5:
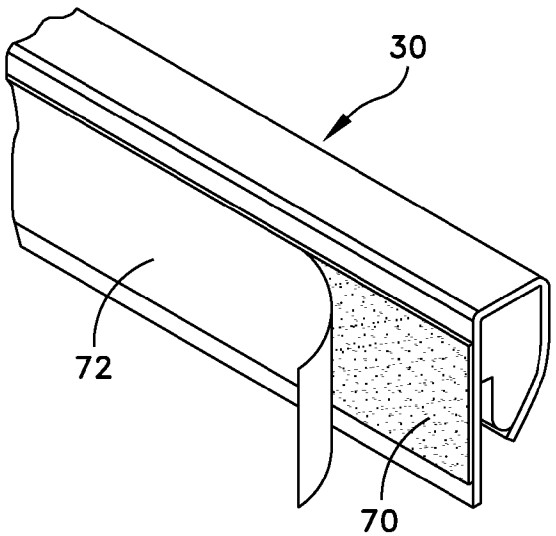
FIG. 5 is a partial rear perspective of the ticket retainer.

Reference is also now made to FIGS. 5, 6 and 8 for an illustration of further details of the ticket retainer 30. The ticket retainer 30 may be provided in lengths that can be cut to match the length of each of the holders 20. The ticket retainer may be secured to its associated holder in a number of different ways. In FIG. 5 this is illustrated as using a double-sided adhesive member 70. The member 70 may be covered by a strip 72 that can be readily peeled off from the layer 70 when it is desired to attach the ticket retainer 30 to the holder 20. As illustrated in the cross-sectional view of FIG. 8, the ticket retainer 30 may be constructed to form an internal pocket 75 in which there are disposed a series of spacedly arranged balls 76. FIG. 8 also illustrates the order ticket at 80 inserted within the retainer 30 and essentially captured by one or more of the balls 76. Although the ticket can be easily retained when inserted in the manner shown in FIG. 8 upwardly, the ticket can also be easily removed by simply pulling downwardly on the ticket.

Figure 10:
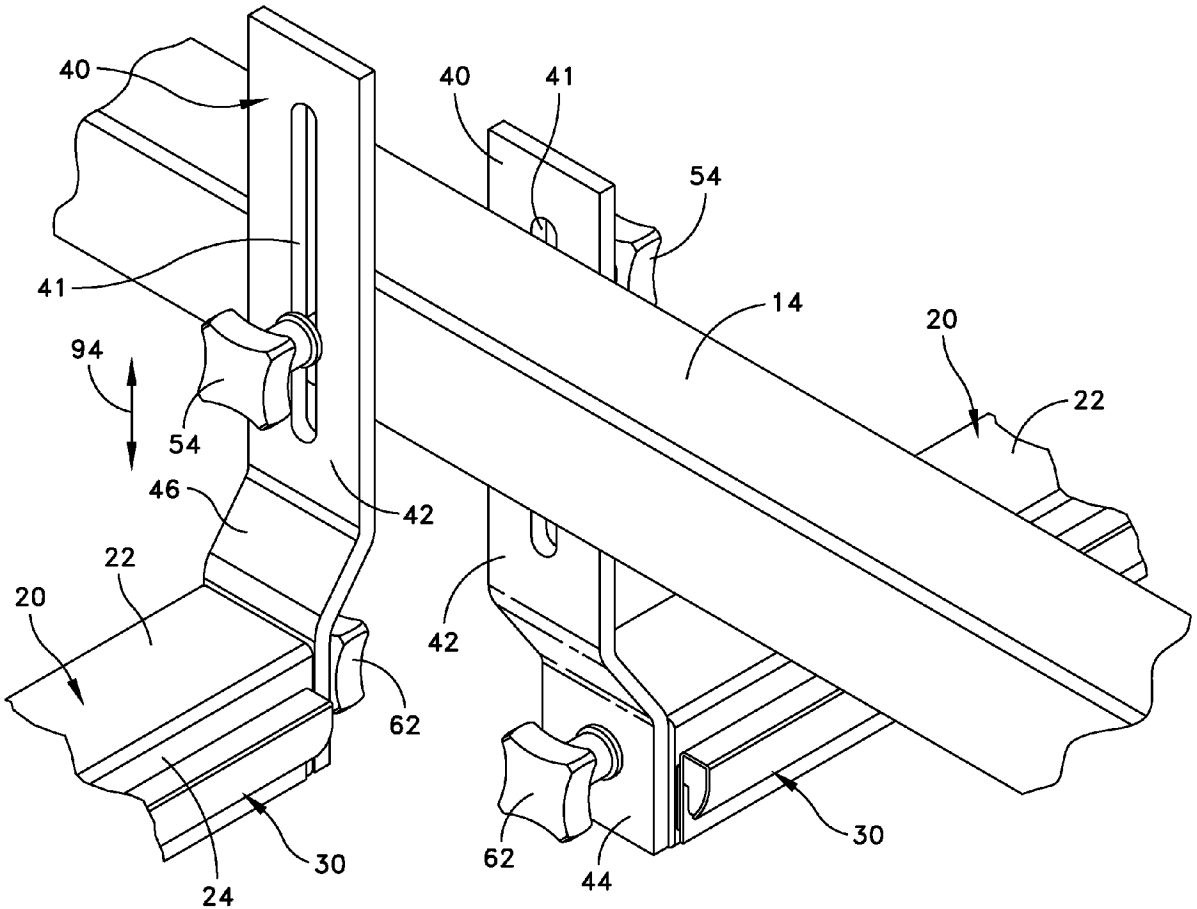
FIG. 10 is a partial perspective view also illustrating the two separate holders and associated brackets for attachment to the center rail.

Reference is now made to FIG. 10 which is a partial perspective view taken in the area where the holders attach with the rail 14. A bracket 40 is disposed on either side of the rail 14 and may be tightened with the rail by means of respective the locking knobs 54. In this view the brackets are substantially vertical and the face 24 of each of the holders 20 is also substantially vertical. The lower end of each bracket secures to the holder by means of the locking knobs 62. Note is also taken of the displacement between the holders 20 that is possible by having the tapered middle sections 46. In that way the lower knobs 62 are not in interference with each other, and yet the respective holders are in relatively close proximity to each other.

Figure 12:
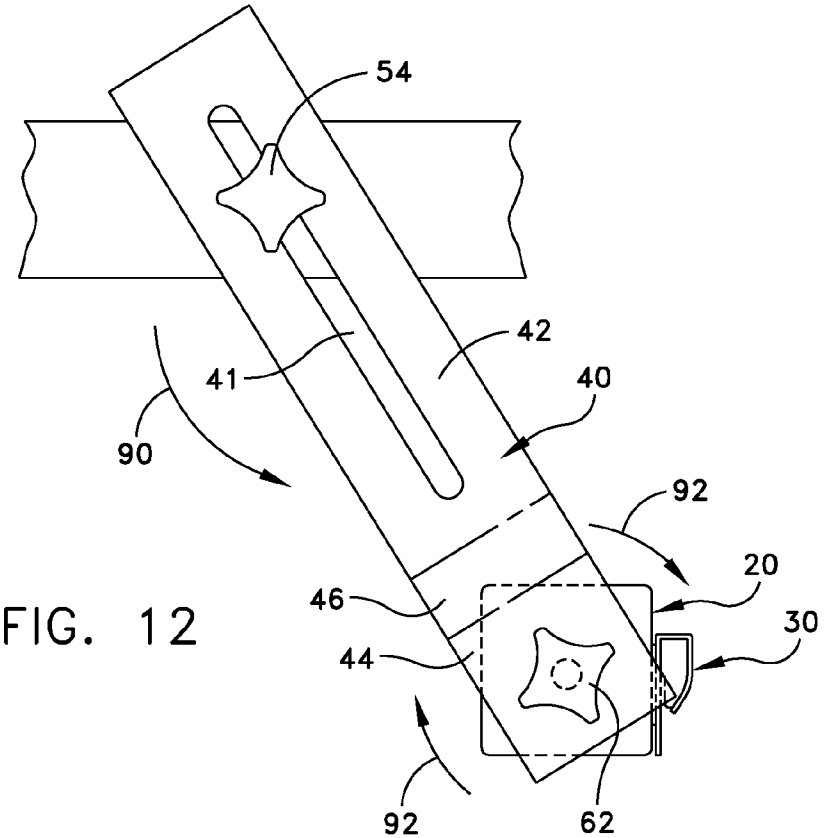
FIG. 12 schematically illustrates the bracket being tilted, as well as the holder being tilted as indicated by the arrows.
Figure 11:
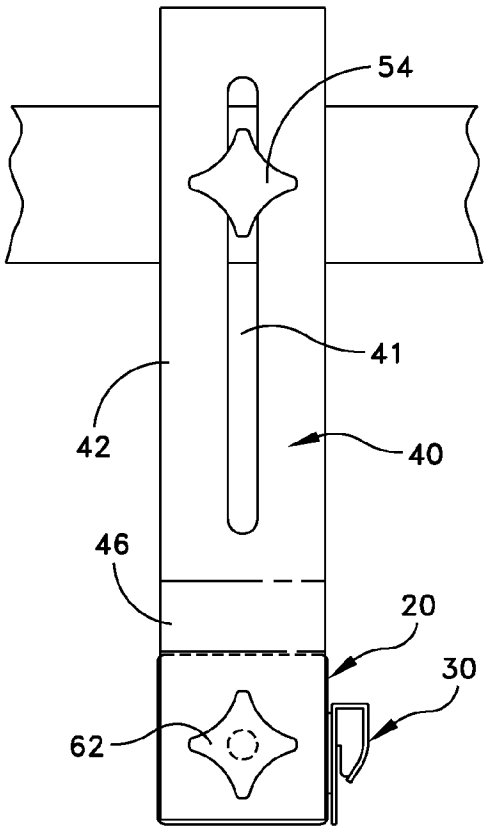
FIG. 11 illustrates the holder in a substantially vertical position.

Reference is now made to FIGS. 11 and 12 for schematic illustrations of the manner in which the order ticket holder may be positioned relative to the cooking station. In FIG. 11, as mentioned previously, the bracket 40 is maintained substantially vertical and the holder 20 is essentially in line with the bracket and not rotated relative thereto. Thus, the front face or wall 24 of the holder 20 is also substantially vertical as viewed in FIG. 11.

FIG. 12, on the other hand, illustrates the manner in which the position of the bracket may be altered by rotation such as in the direction of arrow 90 illustrated in FIG. 12 at the top end of the bracket. Moreover, the position of the holder 20 relative to the bracket 40 can also be altered such as by rotation in the direction of arrows 92 in FIG. 12 at the bottom end of the bracket. The respective knobs 54 and 62 are tightened once the desired position is reached. It is noted that in the position of FIG. 12, the holder 20 is maintained with its front wall facing forwardly in a similar manner to the position of the retainer in FIG. 11. In addition, the knobs 62 can be loosened and the front wall 24 may also be tilted either upwardly or downwardly so as to provide a convenient location for the ticket retainer 30. In FIG. 12, in addition to the position illustrated, the bracket 40 may also be tilted rearwardly if that is a more convenient position for viewing the tickets.

Figure 13:
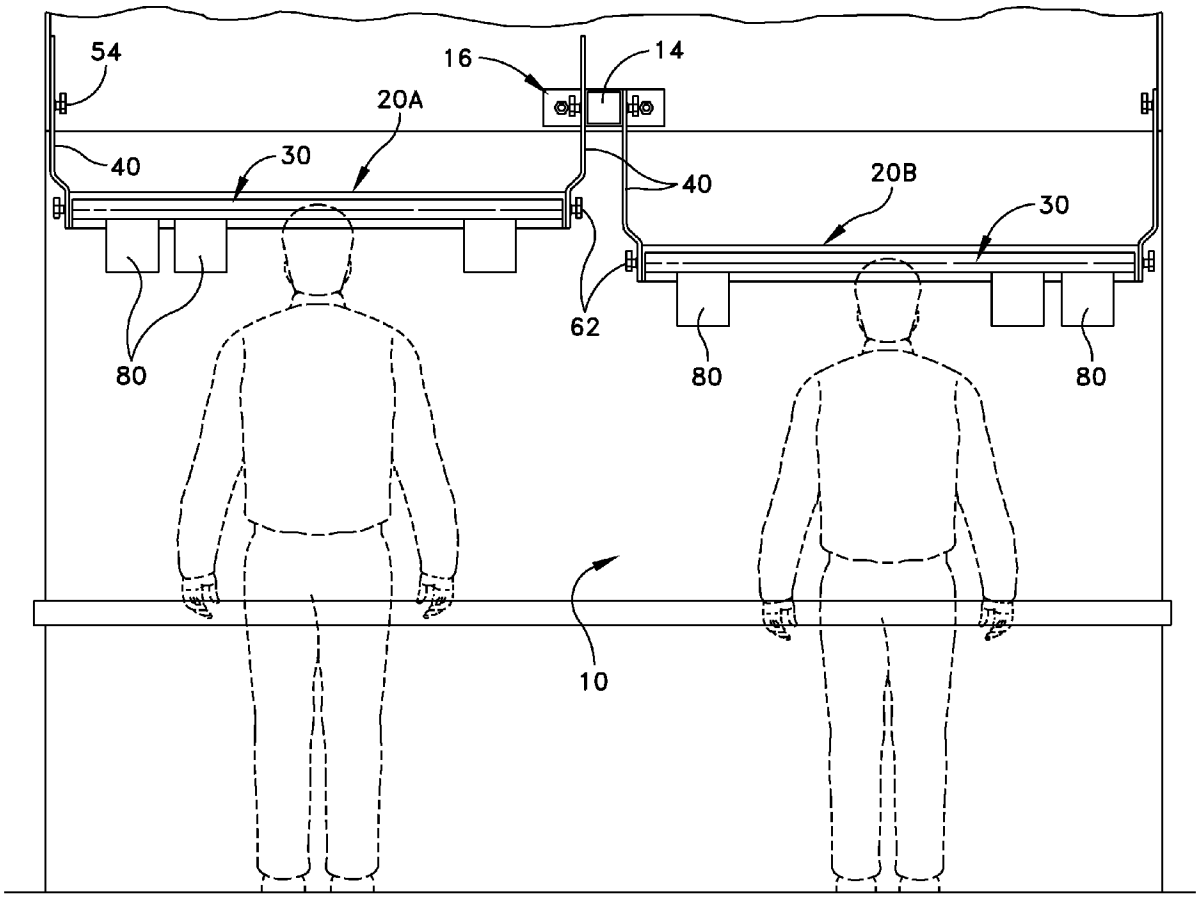
FIG. 13 is a front view showing the different placements of the holders associated with different height attendants.

FIG. 13 also illustrates the manner in which the brackets 40 may be modified. In addition to the rotation mentioned with regard to the knobs 54 and 62, and as illustrated in FIG. 10, the knob 54 may be loosened so that the bracket 40 can be slid up and down in a vertical direction as indicated by the arrow 94 in FIG. 10. In this regard and with reference to FIG. 13, it is noted that the attendant on the right is shorter in stature than the one on the left and thus the brackets 40 on the right have been adjusted so that the holder 20B is at a lower position than the holder 20A. These holders are preferably at a position close to the eye height of the particular attendant. However, the brackets may also be adjusted so that the holders are above or below eye height. In FIG. 13 it is also noted that the holders are of substantially the same length.

Having now described a limited number of embodiments of the present invention, it should now be apparent to those skilled in the art that numerous other embodiments and modifications thereof are contemplated as falling within the scope of the present invention defined by the appended claims. For example, various types of rotational fasteners have been shown including knob arrangements. However, other types of rotational members may also be used. Also, the knobs are shown as engaging with bolts. However, these knobs may also be situated so that the knob becomes a male member for engagement with a nut that is secured to the walls of the vent or the center rail. Moreover, as indicated previously, the order ticket holders may be provided in different lengths and in different numbers of sets depending upon the particular cooking station configuration. As indicated in FIG. 1, the brackets 40 are disposed so that each of the ticket holders and associated retainers are disposed preferably at eye level and in a convenient location for viewing as the attendant cooks the food. In FIG. 1 this is a position slightly rearward of the front of the equipment at the cooking station. The brackets 40 themselves may be of various lengths again depending upon the particular layout of the cooking area. In still another embodiment of the present invention the center rail may be optional particularly where the sidewalls are close together and thus only a single holder is used supported between the sidewalls. In still another modification the slot may be in a lower part of the bracket 40 and the single hole in an upper part thereof.

What is claimed is:

1. An order ticket holding system, in combination with a cooking station, said order ticket holding system mounted at the cooking station in view of a cooking attendant at the cooking station and for holding one or more order tickets for meals being prepared, said order tickets supported in a manner to be readily viewable by the cooking attendant, said cooking station comprising:

at least one cooking unit and an overhead vent for exhausting air generated from the cooking unit;

said order ticket holding system comprising:

an elongated holder that is meant for substantially horizontal support over the cooking unit so that order tickets mounted therefrom are viewable by the cooking attendant;

an elongated ticket retainer that is secured to a planar face surface of the elongated holder and capable of releasably retaining one or more order tickets;

a pair of brackets that support respective end walls of the elongated holder at a position disposed over the cooking unit so that order tickets mounted by the ticket retainer are viewable by the cooking attendant;

the pair of brackets and elongated holder cooperatively constructed and arranged so that the elongated holder is both pivotal relative to the brackets and adjustable in height relative to separate spaced apart members;

each bracket includes an elongated planar top section having an elongated slot, a planar bottom section extending substantially in parallel to the planar top section and having a hole therethrough and a planar middle section that tapers diagonally between, and is integrally formed with, the top and bottom sections;

the tapered planar middle section constructed and arranged to that the respective top sections are spaced apart a greater distance than the length of the elongated holder;

the pair of brackets mounted from respective side support surfaces of the separate spaced apart members so that the brackets are spaced from each other and mount the bottom sections of the brackets between respective end walls of the elongated holder;

a first pair of fasteners for pivotally supporting the end walls of the elongated holder between the bottom sections of respective brackets by engaging each fastener through the planar bottom section hole and into the end wall of the elongated holder;

and a second pair of fasteners for pivotally supporting each top section of the bracket to the respective separate spaced apart member by engaging each fastener through the slot of the top section and into the separate spaced apart member.

2. The combination of claim 1 wherein each first fastener includes a securing knob having loosened and secured positions, that can be loosened to enable the elongated holder to be pivoted relative to the brackets to adjust the position of the elongated holder and secured so as to fix the position of the elongated holder relative to the brackets.

3. The combination of claim 1 wherein each second fastener includes a securing knob having loosened and secured positions, that can be loosened to enable the brackets to be pivoted relative to the separate spaced apart members to adjust the position of the brackets and secured so as to fix the position of the brackets relative to the separate spaced apart members.

4. The combination of claim 2 wherein each second fastener includes a securing knob having loosened and secured positions, that can be loosened to enable the brackets to be pivoted relative to the separate spaced apart members to adjust the position of the brackets and secured so as to fix the position of the brackets relative to the separate spaced apart members.

5. The combination of claim 4 wherein the second pair of fasteners engage through the respective elongated slot and the second fastener knobs can be loosened to enable the brackets to be moved in height relative to the separate spaced apart members to adjust the position of the brackets and secured so as to fix the height position of the brackets relative to the separate spaced apart members.

6. The combination of claim 1 wherein the cross-section of the elongated holder is substantially square having its planar face surface directed forwardly, and having its end walls extending substantially perpendicular to the planar face surface.

7. The combination of claim 6 wherein each first fastener includes a securing knob having loosened and secured positions, that can be loosened to enable the elongated holder to be pivoted relative to the brackets to adjust the position of the elongated holder and secured so as to fix the position of the elongated holder relative to the brackets, and wherein the first fastener securing knobs are disposed outboard of said respective bracket planar bottom section.

8. The combination of claim 7 wherein each second fastener includes a securing knob having loosened and secured positions, that can be loosened to enable the brackets to be pivoted relative to the separate spaced apart members to adjust the position of the brackets and secured so as to fix the position of the brackets relative to the separate spaced apart members, and wherein the second fastener securing knobs are disposed inboard of said respective bracket elongated planar top section.

9. The combination of claim 8 wherein the second fastener comprises a threaded member for engagement in the elongated slot of respective bracket elongated planar top sections, each elongated planar top thereof having the fastener threaded members slideable within respective elongated slots.

10. The combination of claim 9 wherein each second fastener securing knob fixes the height of the brackets and correspondingly the height of the elongated holder.

11. The combination of claim 10 wherein each second fastener securing knob fixes a pivot position of the brackets by rotating the brackets relative to the threaded members.

12. The combination of claim 1 wherein each spaced apart member comprises one of a rail and cooking station side wall.

13. The combination of claim 1 wherein each second fastener includes a securing knob having loosened and secured positions, that can be loosened to enable the brackets to be pivoted relative to the separate spaced apart members to adjust the position of the brackets and secured so as to fix the position of the brackets relative to the separate spaced apart members.

14. The combination of claim 13 wherein the second fastener securing knobs are disposed inboard of said respective bracket elongated planar top section.

15. The combination of claim 14 wherein the second fastener comprises a threaded member for engagement in the elongated slot of respective bracket elongated planar top sections, each elongated planar top thereof having the fastener threaded members slideable within respective elongated slots.

16. The combination of claim 15 wherein each second fastener securing knob fixes the height of the brackets and correspondingly the height of the elongated holder.

17. The combination of claim 16 wherein each second fastener securing knob fixes a pivot position of the brackets by rotating the brackets relative to the threaded members.

* * * * *